US007975909B2

(12) United States Patent
Lee et al.

(10) Patent No.: US 7,975,909 B2
(45) Date of Patent: Jul. 12, 2011

(54) DEVICE OF SUPPLYING PAPER MEDIUM

(75) Inventors: Won Joon Lee, Seoul (KR); Jin Hwan Cha, Gyeonggi-do (KR)

(73) Assignee: Nautilus Hyosung Inc., Seoul (KR)

( * ) Notice: Subject to any disclaimer, the term of this patent is extended or adjusted under 35 U.S.C. 154(b) by 396 days.

(21) Appl. No.: 12/338,301

(22) Filed: Dec. 18, 2008

(65) Prior Publication Data

US 2009/0159662 A1 Jun. 25, 2009

(30) Foreign Application Priority Data

Dec. 21, 2007 (KR) ..... 10-2007-0134991

(51) Int. Cl.
*G07F 19/00* (2006.01)

(52) U.S. Cl. ..... 235/379; 902/8; 902/12; 902/13; 902/14; 902/17

(58) Field of Classification Search ..... 235/379
See application file for complete search history.

(56) References Cited

U.S. PATENT DOCUMENTS

2006/0244193 A1* 11/2006 Lee et al. ..... 271/10.01

FOREIGN PATENT DOCUMENTS

| | | |
|---|---|---|
| JP | H07-200921 | 8/1995 |
| JP | H07-237784 | 9/1995 |
| KR | 2003-93559 | 12/2003 |
| KR | 2007-51989 | 5/2007 |

* cited by examiner

*Primary Examiner* — Michael G Lee
*Assistant Examiner* — Kristy A Haupt
(74) *Attorney, Agent, or Firm* — Fenwick & West LLP

(57) ABSTRACT

Disclosed are an automatic transaction machine and method of rejecting a paper medium in the automatic transaction machine. The automatic transaction machine includes a medium storage portion; a first medium transfer module transferring a paper medium in a sheet unit from the medium storage portion; a temporary stack portion provided adjacent to an outlet of the first medium transfer module, stacking the paper medium, and having a vertically movable supporter; a second medium transfer module for transferring, to a medium outlet, the paper medium transmitted from the supporter having been upwardly moved; and a rejection portion positioned below the supporter, and including a rejection inlet vertically movable together with the supporter.

7 Claims, 6 Drawing Sheets

DEVICE OF SUPPLYING PAPER MEDIUM

CROSS-REFERENCE TO RELATED APPLICATION

This application claims the benefit of Republic of Korea Patent Application No. 10-2007-0134991, filed on Dec. 21, 2007, in the Korean Intellectual Property Office, the disclosure of which is incorporated herein by reference.

BACKGROUND

1. Field of the Invention

The present invention relates to an automatic transaction machine, and more particularly, to an automatic transaction machine and method of rejecting a paper medium in the automatic transaction machine, in which a paper medium provided in a sheet unit may be stored in a temporary stack portion, or may be rejected.

2. Description of the Related Art

In general, an automatic transaction machine provides basic financial services such as a money reception/dispensing without a bank teller regardless of time and location. The automatic transaction machine is classified into a cash dispensing machine and a cash depositing/dispensing machine depending on money reception/dispensing. Recently, the automatic transaction machine has been used for multiple purposes such as a check reception/dispensing, bank book update, Giro payment, ticket dispensing, and the like, in addition to the money reception/dispensing.

In general, the automatic transaction machine may pick up and transfer a paper medium in a sheet unit from a paper medium storage portion, and the transferred paper medium may be directly moved to a dispensing portion or temporarily stored in a temporary stack portion, and then moved to the dispensing portion. In a case of using the temporary stack portion, the paper medium may be provided to a customer in a stack unit. However, the paper medium stored in the temporary stack portion may need to be arranged to be transferable to a transfer device for transferring the paper medium in a stack unit, and the transfer device may need to transfer a sheet or several sheets of the paper medium, whereby the paper medium in the stack unit is required to be appropriately pressed and transferred.

An automatic transaction machine according to the present invention that may provide a simple rejection path without mounting a rejection blade or a separate transfer path in a process for rejecting paper medium transferred in a paper medium transfer module is disclosed.

SUMMARY

An aspect of the present invention provides an automatic transaction machine and a rejection method of the automatic transaction machine, in which a simple rejection path may be provided without mounting a rejection blade or a separate transfer path in a process for rejecting paper media transferred in a paper medium transfer module is disclosed.

According to an aspect of the present invention, there is provided an automatic transaction machine, including: a medium storage portion; a first medium transfer module transferring a paper medium in a sheet unit from the medium storage portion; a temporary stack portion provided adjacent to an outlet of the first medium transfer module, stacking the paper medium, and having a vertically movable supporter; a second medium transfer module for transferring, to a medium outlet, the paper medium transmitted from the supporter having been upwardly moved; and a rejection portion positioned below the supporter, and including a rejection inlet vertically movable together with the supporter. In this instance, when the paper medium needs to be rejected due to skew, two papers, paper damage, counterfeit money, and the like, the automatic transaction machine may enable the supporter to be moved upwardly, so that an inlet of the rejection portion is located adjacent to the outlet of the first medium transfer module, and a rejection process of the paper medium may be terminated.

A part or all of the rejection portion may be mounted below the supporter to move together with the temporary stack portion, and operations of the temporary stack portion may enable functions of the temporary stack portion and rejection portion to be simultaneously implemented. Also, in a conventional art, a method in which a separate transfer path is provided to implement a rejection function, and the transfer path is changed by a rejecting blade may be used, however, according to the present aspect of the invention, the separate transfer path may not need to be provided, and the paper medium to be rejected may be accurately divided by ascending/descending operations of the temporary stack portion that is different from the rejecting blade.

As described above, the rejection portion including a rejection box may be mounted below the temporary stack portion, however, the rejection box may be separately mounted from the temporary stack portion and only a rejection transfer path may be mounted in the temporary stack portion, as necessary.

The medium storage portion and the medium transfer module may use a conventional device. For example, an upward pick-up and downward pick-up cassette may be used as the medium storage portion, and a pick-up portion including a pick-up roller may be also internally or externally mounted in the medium storage portion. Also, the medium transfer module may use schemes using a belt-pulley or using a roller-guidance plate, or a scheme for transferring the paper medium in a stack unit using a separate carriage.

According to another aspect of the present invention, there is provided a method of rejecting a paper medium in an automatic transaction machine, the method including: feeding a paper medium in a sheet unit from a medium storage; transferring the fed paper medium to a supporter of a temporary stack portion using a first medium transfer module; determining whether the transferred paper medium is rejected; elevating the supporter when an unacceptable paper medium is present, the unacceptable paper medium being an object to be rejected; enabling a rejection inlet positioned below the supporter to be located to correspond to an outlet of the first medium transfer module; guiding the unacceptable paper medium to a rejection box through the rejection inlet; and suspending a supply of the paper medium from the medium storage portion independent from the first medium transfer module, when the unacceptable paper is present.

BRIEF DESCRIPTION OF THE DRAWINGS

The above and/or other aspects and advantages of the present invention will become apparent and more readily appreciated from the following detailed description, taken in conjunction with the accompanying drawings.

DETAILED DESCRIPTION

Figure 1:
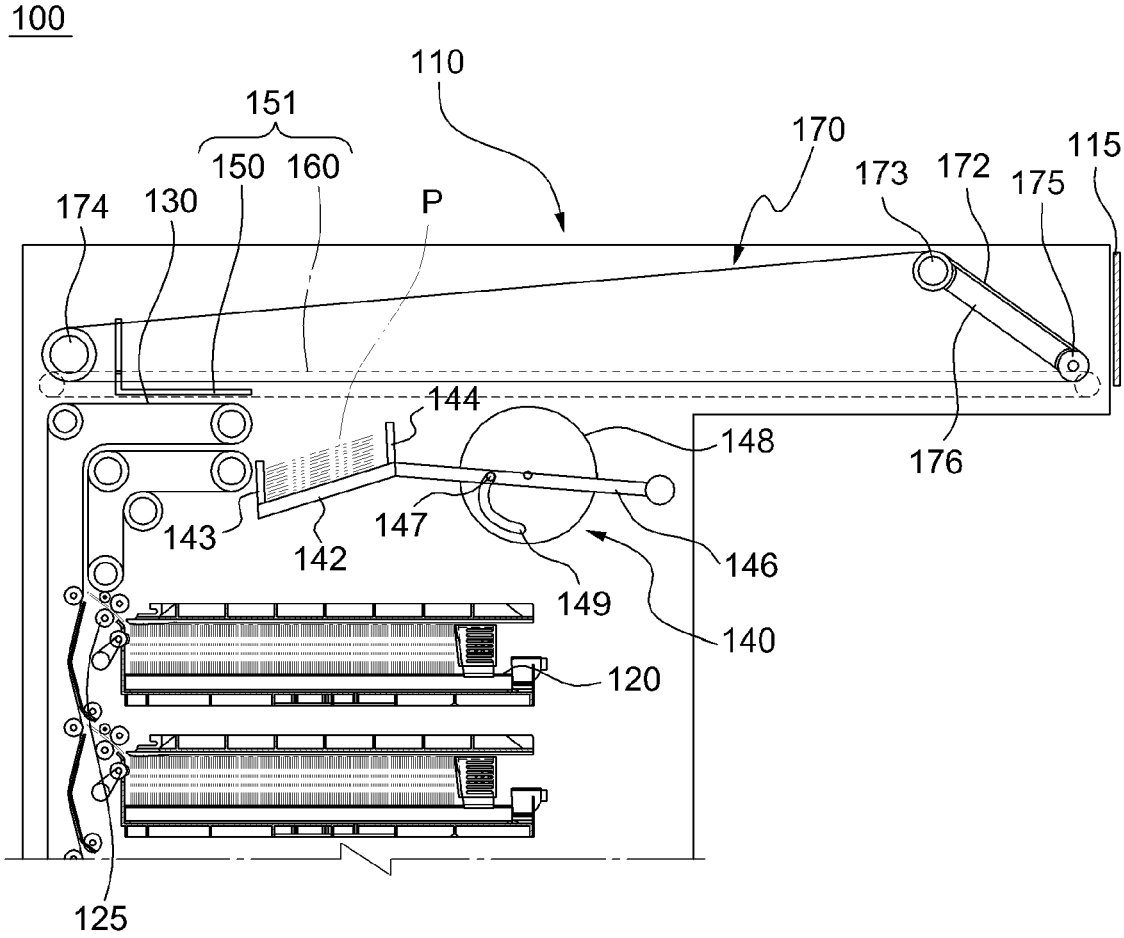
FIG. 1 is a side view showing an automatic transaction machine according to an exemplary embodiment of the present invention.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

Figure 2:
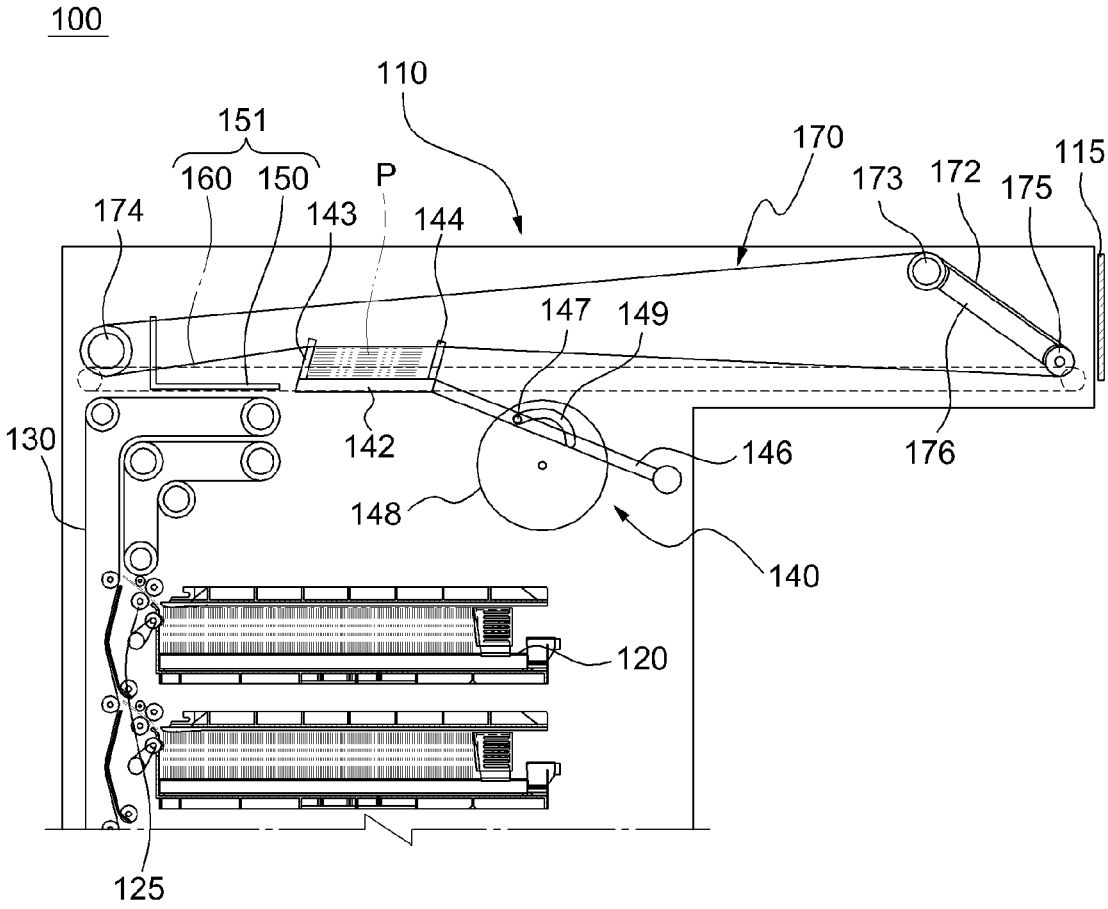
FIG. 2, FIG. 3, and FIG. 4 are side views showing an operation mechanism of the automatic transaction machine of FIG. 1.
Figure 3:
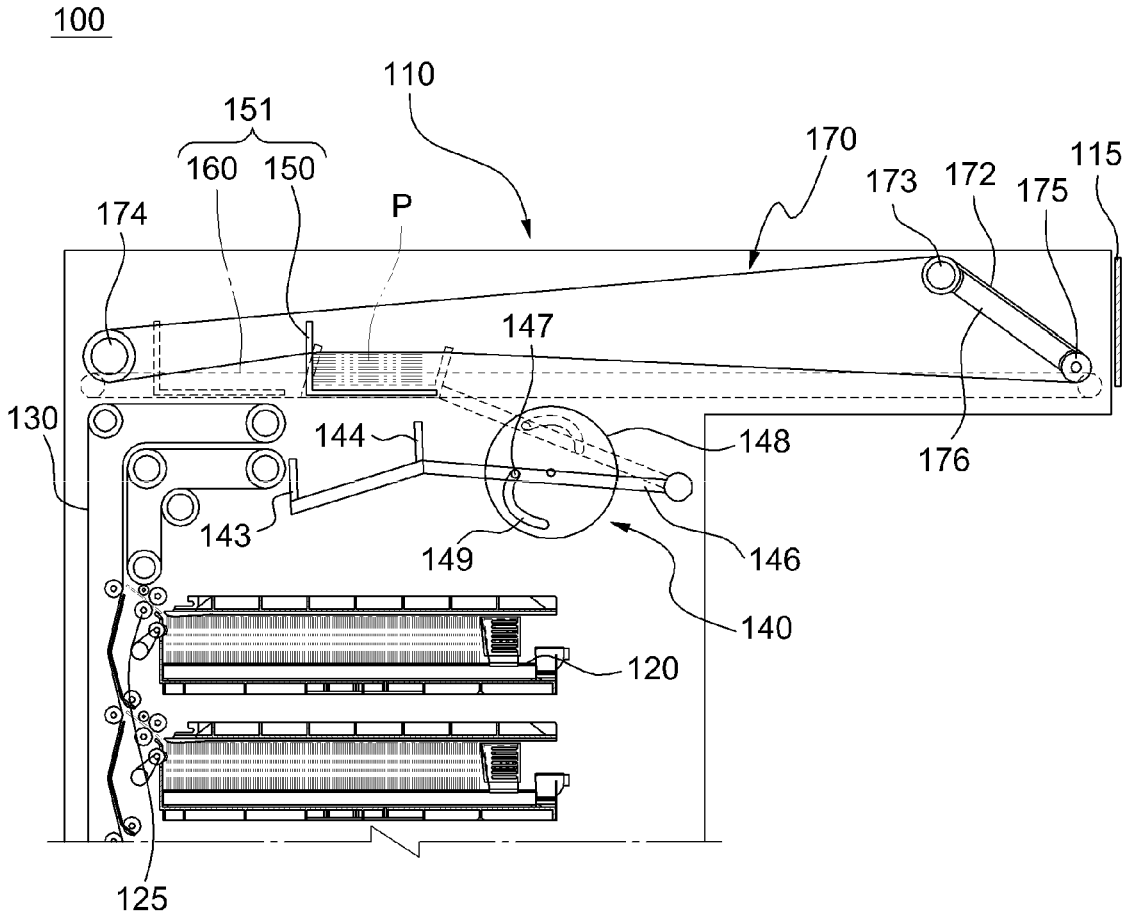
Figure 4:
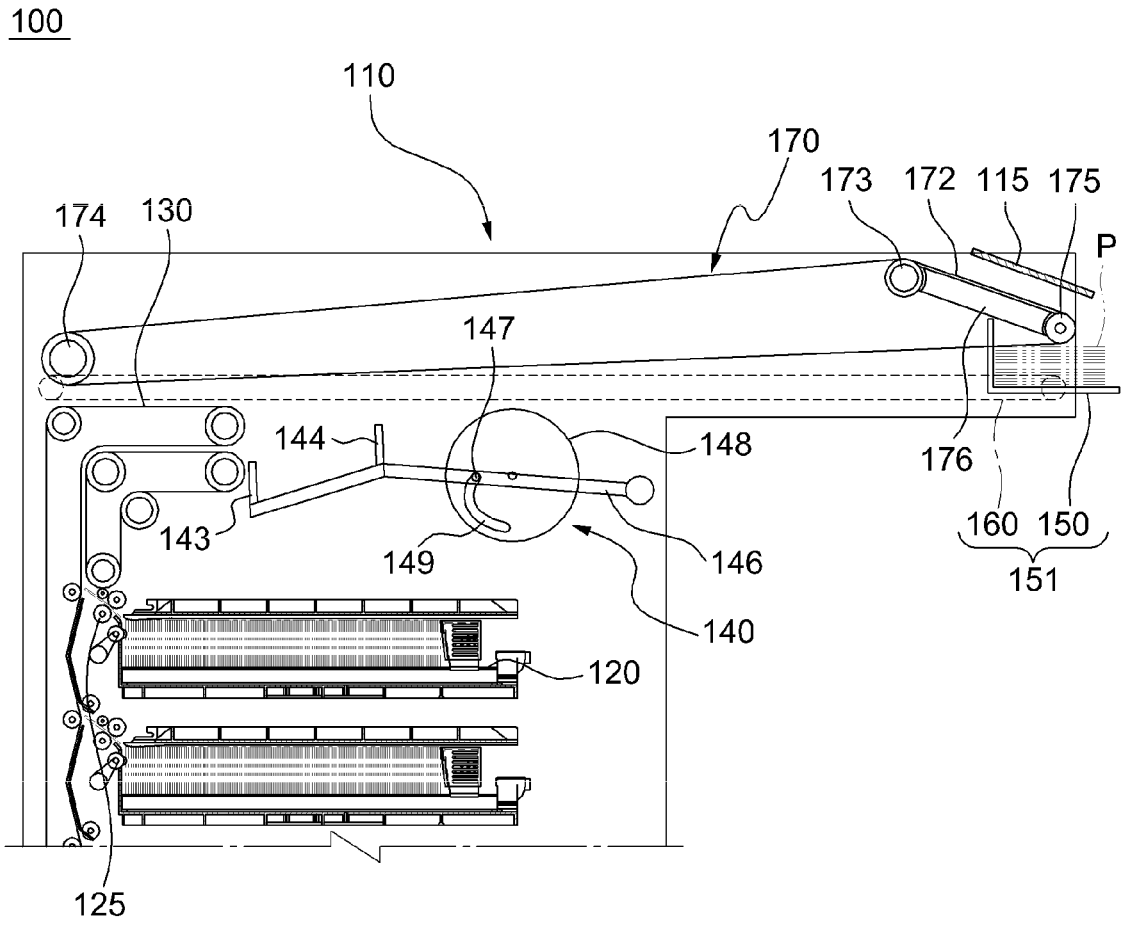

FIG. 1 is a side view showing an automatic transaction machine 100 according to an exemplary embodiment of the present invention, and FIG. 2, FIG. 3, and FIG. 4 are side views showing an operation mechanism of the automatic transaction machine 100 of FIG. 1.

Referring to FIG. 1, the automatic transaction machine 100 according to the present exemplary embodiment may include a medium storage portion 120 mounted inside a housing 110, a first medium transfer module 130, a temporary stack portion 140, a second medium transfer module 151, and a belt pressing portion 170. The paper medium (P) may be picked-up and provided in a sheet unit in the medium storage portion 120, and the provided paper medium (P) may be transferred to the temporary stack portion 140 through the first medium transfer module 130. The paper medium (P) provided in a sheet unit may be stacked in the temporary stack portion 140, and then a stack of the paper medium may be transmitted to a carriage 150 of the second medium transfer module 151 when a desired amount of the paper medium (P) are stacked. The stack of the paper medium transmitted to the carriage 150 may move to a medium outlet 115 together with the carriage 150, and the paper medium may be dispensed in a stack unit to a customer at the medium outlet 115. In this instance, the belt pressing portion 170 may pressure an upper surface of the stack of the paper medium transmitted by the carriage 150 to thereby enable the paper medium to be stably maintained without being scattered while the carriage is moving or while the paper medium is being rejected. Hereinafter, the above-mentioned functions will be described in detail.

The medium storage portion 120 may store the paper medium (P) such as paper money, a check, an exchange ticket, and the like, and a main controller (not shown) of the automatic transaction machine may command that a certain amount of the paper medium is dispensed from the stored paper medium (P) when a customer wishes to withdraw a predetermined amount of the paper medium. In this instance, a pick-up module 125 may be internally or externally mounted in the medium storage portion 120, and the pick-up module 125 may pick-up a certain amount of the paper medium from the medium storage portion 120. In general, the pick-up module 125 may include a pick-up roller, a feed roller, a gate roller, a pinch roller, and the like, and configurations and functions thereof may be apparent to a skilled person in the art, and thus detailed description thereof will be omitted.

The medium storage portion 120 may further include a step motor for driving the pick-up module 125 although not shown, and the step motor may be operated separately from a driving motor of the first medium transfer module 130. Accordingly, the pick-up roller and the feed roller may be stopped even though the first medium transfer module 130 is driven. Specifically, the pick-up roller and feed roller may be stopped when an unacceptable paper medium is detected, which will be described in detail hereinafter. In this instance, a further feeding of the paper medium into the first medium transfer module 130 may be limited although the paper medium is transferred by the first medium transfer module 130.

The paper medium picked-up and provided from the medium storage portion 120 may be transmitted to the temporary stack portion 140 through the first medium transfer module 130. The first medium transfer module 130 according to the present exemplary embodiment may utilize a transfer scheme using a belt and roller, however, may utilize a transfer scheme using a roller and guidance plate, as necessary. An outlet of the first medium transfer module 130 may be connected with the temporary stack portion 140, and the paper medium may be stacked in a sheet unit in the temporary stack portion 140.

Referring to FIG. 1, the temporary stack portion 140 according to the present exemplary embodiment may include a supporter 142, a front partition wall 144, a rear partition wall 143, a rotation supporter 146, and a rotation guide 148. The supporter 142 and the rotation supporter 146 may be integrally formed, and the supporter 142 may be upwardly and downwardly movable depending on rotation operations of the rotation supporter 156. Specifically, the supporter 142 may be located adjacent to the outlet of the first medium transfer module 130, and also may be upwardly moved so as to transmit the paper medium to the carriage 150.

Also, the front partition wall 144 and rear partition wall 143 may be respectively provided at front and rear ends of the supporter 142. The front partition wall 143 may interrupt an advancement of the paper medium transmitted from the first medium transfer module 130, and the advancement of the paper medium may be interrupted for a period of time by the front partition wall 144 when a sheet roller is mounted in the outlet of the first medium transfer module 130, and then the paper medium may be downwardly guided by the sheet roller. The rear partition wall 143 may guide the paper medium to be stacked on the supporter 142 in a state of being arranged. In this instance, the supporter 142 may be provided as being downwardly slant in front of the outlet of the first medium transfer module 130, so that the paper medium is neatly arranged.

Also, as shown in FIG. 1, the rotation guide 148 may include a spiral guidance groove 149 formed thereon, and the radius of the spiral guidance groove 149 may vary depending on a rotation angle. The rotation supporter 146 may include a protrusion 147 engaged with the guidance groove 149. Accordingly, when the rotation guide 148 is rotated clockwise, the rotation supporter 146 and the supporter 142 may ascend, and when the rotation guide 148 is rotated counterclockwise, the rotation supporter 146 and the supporter 142 may descend.

According to the present exemplary embodiment, the above-mentioned temporary stack portion 140 may be provided, however, various kinds of temporary stack portions according to other exemplary embodiments may be provided, and the present invention may not limited thereto. Also, various kinds of devices for ascending the supporter, which will be well-known to a skilled person in the art, may be used.

The carriage 150 may be provided to have a structure of being partially overlapped with the supporter 142 of the temporary stack portion 140, and may be generally formed into a fork shape having a plurality of supporters. When the supporter 142 is upwardly moved, the carriage 150 is moved forward so that a lower portion of the carriage 150 is inserted into the supporter 142, whereby the lower portion of the carriage 150 is located on a bottom surface of the paper medium.

Also, the belt pressing portion 170 may be provided above the carriage 150. The belt pressing portion 170 may press the upper surface of the paper medium while the carriage 150 is moving, whereby the paper medium is stably transferred without being scattered. For this purpose, the belt pressing portion 170 may include a belt 172 pressing the upper surface of the paper medium, a plurality of guidance rollers 173, 174, 175 defining a travel path of the belt 172, and a tension spring 176 connecting both ends of the belt 172. The belt 172 may be provided with two-folds or more so as to stably press the paper medium.

The plurality of guidance rollers may include a front fixed roller 173, a rear fixed roller 174, and a front moving roller 175 vertically swiveled while maintaining a certain distance with the front fixed roller 173. A support member 176 between the front moving roller 175 and the front fixed roller 173 may be interposed. Specifically, the support member 176 may be mounted on a rotation shift of the front fixed roller 173, and the front moving roller 175 may be rotatably mounted on an end of the supporter member 176. Accordingly, the front moving roller 175 may be vertically swiveled together with the support member 176, whereby the front moving roller 175 can ascend together with the supporter member 176 when the carriage 150 approach the front moving roller 175, and descend when the carriage 150 is withdrawn from the front moving roller 175.

The belt 172 may be suspended without regard to the carriage 150, however, may be preferably moved by the same displacement as that of the movement of the carriage 150 in order to reduce friction between the belt 172 and the paper medium. For this purpose, the belt 172 or the plurality of guidance rollers 173 to 175 may cooperate with a carriage transfer portion 160. Various methods in which the carriage transfer portion 160 and the belt 172 cooperate with each other may be used.

As an example, the carriage transfer portion 160 may include a separate driving belt for cooperating with the belt pressing portion 170 provided outside the belt pressing portion 170. The carriage 150 may be fixed on the driving belt mounted outside the belt pressing portion 170, so that the carriage is moved along the driving belt. In this instance, the belt 172 of the belt pressing portion 170 may be in a free rotation state or in an idler state, whereby the belt 172 is circulated together with the paper medium. However, upon reverse rotation in a state where a shaft of the belt 172 and a shaft of the carriage transfer portion 160 are connected with each other using a one-way clutch, the belt 172 and the carriage transfer portion 160 may be simultaneously moved. The present exemplary embodiment may adapt the above-mentioned configuration of the belt 172 and the carriage transfer portion 160.

As another example, a method for directly connecting the belt 172 of the belt pressing portion 170 and the carriage 150 with each other may be used. In this instance, the belt 172 of the belt pressing portion 170 may be directly connected with the carriage transfer portion 160, and the carriage 150 may be indirectly connected with the carriage transfer portion 160 through the belt 172. In this case, another separate belt other than the belt 172 of the belt pressing portion 170 may not need to be mounted.

According to the present exemplary embodiment, the second medium transfer module may be provided using the carriage, however, according to other exemplary embodiments of the invention, the second medium transfer module may adapt various kinds of medium transfer methods, which are well-known to a skilled person in the art, similarly to the first medium transfer module.

As illustrated in FIG. 2, when a desired amount of the paper medium (P) are stacked on the supporter 142 of the temporary stack portion 140, the rotation guide 148 may be rotated clockwise to enable the supporter 142 to ascend. In this instance, the paper medium (P) stacked on the supporter 142 may be brought into contact with a bottom surface of the belt pressing portion 170, and maintain to be in a neatly arranged state by the belt 172.

Referring to FIG. 3, the carriage 150 may move forward, and may be overlapped with the supporter 140 of the temporary stack portion 140. In this instance, a lower portion of the carriage 150 may be inserted into the supporter 142 along a groove of the supporter 142, and only the paper medium (P) may remain on the carriage 150 while the temporary stack portion 140 is descending when the rotation guide 148 is rotated counterclockwise to enable the supporter 142 to descend.

Referring to FIG. 4, the carriage 150 may move to the medium outlet 115 together with the paper medium (P). The front moving roller 175 may move upwardly while the carriage 150 is moving to the medium outlet 115, the paper medium (P) may be provided in a stack unit through the medium outlet 115. Then, the paper medium (P) may be dispensed to a customer.

Figure 5:
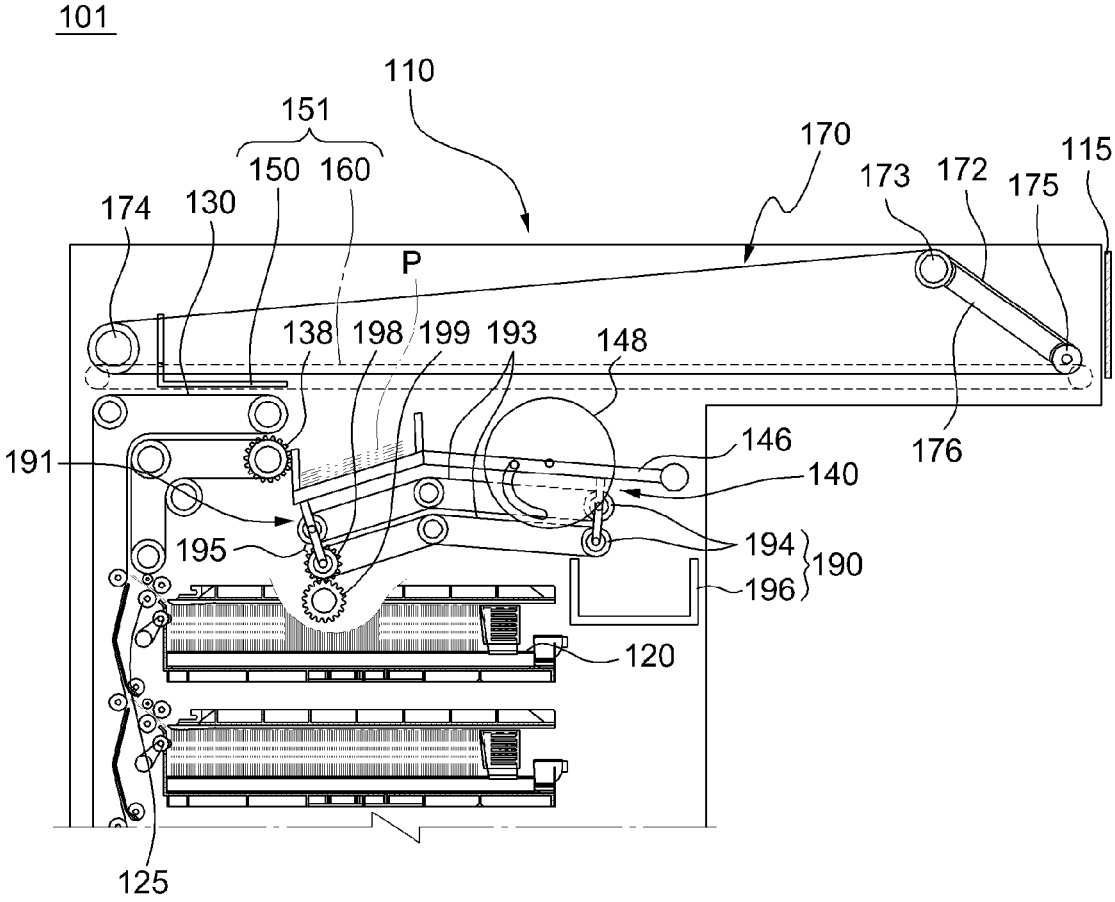
FIG. 5 is a side view showing an automatic transaction machine according to another exemplary embodiment of the present invention.
Figure 6:
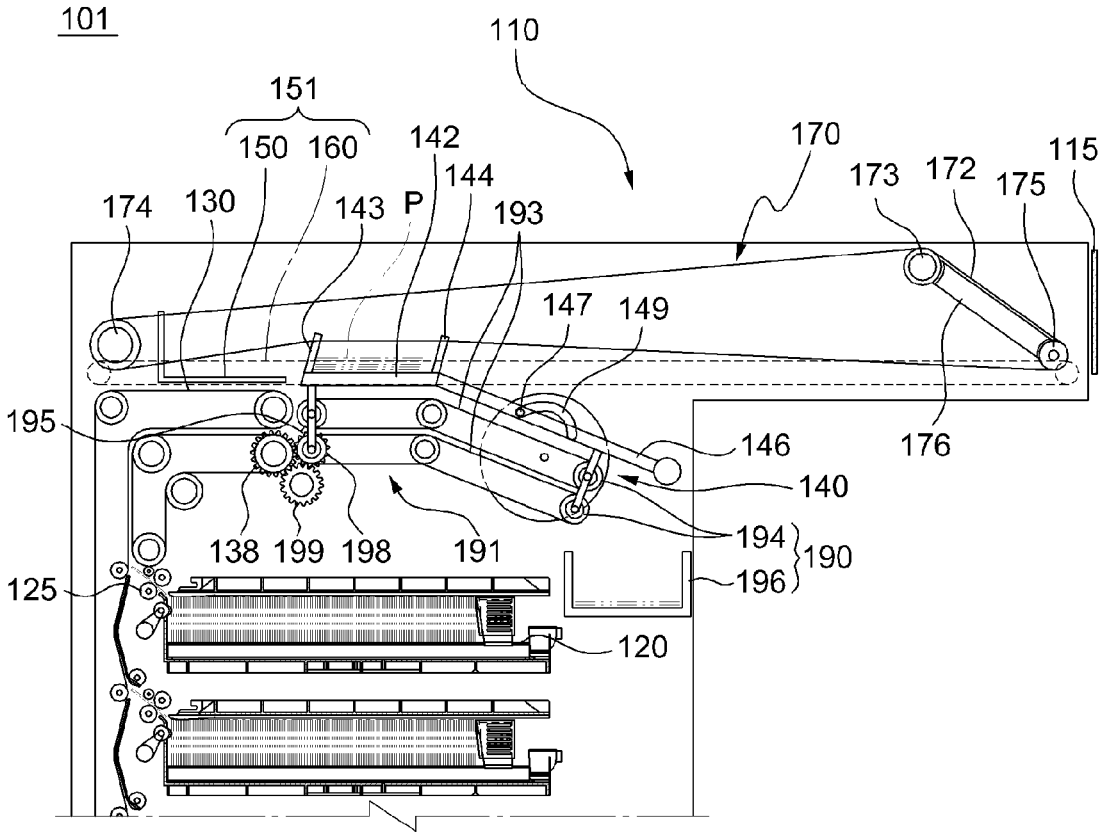
FIG. 6 is a side view showing an operation mechanism of the automatic transaction machine of FIG. 5.

FIG. 5 is a side view showing an automatic transaction machine 101 according to another exemplary embodiment of the present invention, and FIG. 6 is a side view showing an operation mechanism of the automatic transaction machine 101 of FIG. 5.

Referring to FIG. 5, the automatic transaction machine 101 according to the present exemplary embodiment may include a medium storage portion 120 mounted inside a housing 110, a first medium transfer module 130, a temporary stack portion 140, a second medium transfer module 151, a rejection portion 190, and a belt pressing portion 170. In this instance, other configurations except the rejection portion 190 may be the same as those of the automatic transaction machine of FIG. 1, and thus detailed descriptions thereof may be herein omitted.

The rejection portion 190 may include a rejection transfer path 191 and a rejection box 196. The rejection transfer path 191 may be mounted below the supporter 142, and ascend and descend together with the supporter 142. The rejection transfer path 191 may include endless belts 193 respectively provided on a lower and upper portion of the transfer path 191, and the endless belts 193 may move along a certain travel route defined by rollers. A transfer path for rejecting the paper medium (P) may be defined between the endless belts 193. An inlet 195 of the rejection-transfer path 191 may be formed to face the outlet of the first medium transfer module 130, so that an unacceptable paper medium transmitted from the first medium transfer module 130 is guided to the rejection box 196.

The paper medium (P) may be provided from the medium storage portion 120 in a sheet unit. The paper medium (P) may pass through a two sheet-detecting sensor, a skew sensor, a pick-up detecting sensor, a counterfeit note-detecting sensor, and the like, while moving to the temporary stack portion 140 by the first medium transfer module 130. In this instance, the automatic transaction machine may determine using the above-mentioned sensors whether the unacceptable paper medium to be rejected is present. For example, the paper medium may be determined as the unacceptable paper medium such as being two sheets of paper, being skewed by a certain angle or more, being a counterfeit note, being two papers insignificantly divided, being significantly damaged, and the like, and the unacceptable paper medium may move to the rejection box 196.

A process in which the temporary stack portion 140 and the rejection portion 190 are operated to reject the unacceptable paper medium will be described in detail with reference to FIG. 6. As described above, when the unacceptable paper medium to be rejected is detected, the rotation guide 148 may be rotated to enable the supporter 142 and the rotation supporter 146 to ascend. In this instance, the rejection-transfer path 191 mounted below the supporter 142 may accordingly ascend, and the rotation guide 148 may suspend at a location where the inlet 195 of the rejection-transfer path 191 accurately face the outlet of the first medium transfer module 130.

In this instance, a gear 198 of an end roller mounted in the inlet 195 of the rejection-transfer path 191 may be engaged with a gear 138 of an end roller mounted in the outlet of the first medium transfer module 130 using a middle gear 199, and a driving force of the first medium transfer module 130 may be transmitted to the rejection-transfer path 191 via these gears 138, 199, and 198. Specifically, the endless belts 193 and rollers 194 of the rejection-transfer path 191 may receive the driving force from the first medium transfer module 130, be rotated, and transmit, to the rejection box 196, the unacceptable paper medium transmitted through the inlet 195 of the rejection-transfer path 191. The gears 138, 199, and 198 may be located outside a frame, and the frame may include a fan-shaped slit formed thereon for movement of shafts of the gears.

Also, when the unacceptable paper medium to be rejected is detected, the step motor of the medium storage portion 120 may suspend its rotation. As a result, the paper medium may be no longer be provided from the medium storage portion 120, and only the first medium transfer module 130 may be operated, so that the unacceptable paper medium on the path is guided to the rejection box 196.

When a rejection process of the unacceptable paper medium is terminated, the supporter 142 of the temporary stack portion 140 may again descend to be located below the outlet of the first medium transfer module 130, and then the medium storage portion 120 and the first medium transfer module 130 may be again operated to re-start a supply of the remaining paper medium.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. An automatic transaction machine comprising:

a medium storage portion;

a first medium transfer module transferring a paper medium in a sheet unit from the medium storage portion;

a temporary stack portion provided adjacent to an outlet of the first medium transfer module, stacking the paper medium, and having a vertically movable supporter;

a second medium transfer module for transferring, to a medium outlet, the paper medium transmitted from the supporter having been upwardly moved; and a rejection portion positioned below the supporter, and including a rejection inlet vertically movable together with the supporter, wherein the supporter is upwardly moved when rejecting the paper medium, so that the rejection inlet is positioned adjacent to the outlet of the first medium transfer module.

2. The automatic transaction machine of claim 1, wherein the rejection portion includes a rejection-transfer path mounted below the supporter and providing the rejection inlet towards a lower portion of the supporter, and a rejection box storing the paper medium transmitted from the rejection-transfer path.

3. The automatic transaction machine of claim 2, wherein the rejection-transfer path includes endless belts respectively revolving above and below a transferring path of the paper medium, and a roller guiding the endless belt to enable the endless belt to be moved along the transferring path of the paper medium.

4. The automatic transaction machine of claim 1, wherein the medium storage portion includes a pick-up roller, a feed roller, a gate roller, and a pinch roller, and the pick-up roller and the feed roller are driven by a step motor independently operated from the first medium transfer module.

5. The automatic transaction machine of claim 1, wherein the second medium transfer module includes a carriage transferring, to the outlet of the second medium transfer module, the paper medium transmitted from the temporary stack portion, a belt provided along a transfer path of the carriage, and a plurality of guidance rollers defining a travel path of the belt and mounted along the transfer path of the carriage, and wherein the belt presses an upper surface of the paper medium transferred by the carriage.

6. The automatic transaction machine of claim 1, wherein the temporary stack portion further includes a rotation supporter including a rotation guide having a spiral guidance groove formed thereon, a radius of the spiral guidance groove varying depending on a rotation angle, and a protrusion engaged with the guidance groove, the rotation supporter being swiveled within a predetermined angle in response to rotation of the rotation guide, and wherein the rotation supporter is integrally formed with the supporter to convert the rotation of the rotation guide into vertical movement of the supporter.

7. A method of rejecting a paper medium in an automatic transaction machine, the rejection method comprising:

feeding a paper medium in a sheet unit from a medium storage;

transferring the fed paper medium to a supporter of a temporary stack portion using a first medium transfer module;

determining whether the transferred paper medium is rejected;

elevating the supporter when an unacceptable paper medium is present, the unacceptable paper medium being an object to be rejected;

enabling a rejection inlet positioned below the supporter to be located to correspond to an outlet of the first medium transfer module;

guiding the unacceptable paper medium to a rejection box through the rejection inlet; and suspending a supply of the paper medium from the medium storage portion independent from the first medium transfer module, when the unacceptable paper is present.

* * * * *